US008517795B2

(12) United States Patent
Saito et al.

(10) Patent No.: US 8,517,795 B2
(45) Date of Patent: Aug. 27, 2013

(54) SURFACE TREATMENT METHOD FOR VACUUM MEMBER

(75) Inventors: Kenji Saito, Tsukuba (JP); Tamao Higuchi, Osaka (JP)

(73) Assignee: Nomura Plating Co., Ltd., Osaka (JP)

( * ) Notice: Subject to any disclaimer, the term of this patent is extended or adjusted under 35 U.S.C. 154(b) by 1347 days.

(21) Appl. No.: 10/532,586

(22) PCT Filed: Oct. 31, 2003

(86) PCT No.: PCT/JP03/14039

§ 371 (c)(1),
(2), (4) Date: Jun. 17, 2005

(87) PCT Pub. No.: WO2004/041477

PCT Pub. Date: May 21, 2004

(65) Prior Publication Data

US 2005/0282473 A1 Dec. 22, 2005

(30) Foreign Application Priority Data

Nov. 6, 2002 (JP) ..... 2002-323209
Nov. 6, 2002 (JP) ..... 2002-323210
Nov. 6, 2002 (JP) ..... 2002-323212

(51) Int. Cl.
*B24B 49/08* (2006.01)

(52) U.S. Cl.
USPC ..... 451/5; 451/36; 451/37

(58) Field of Classification Search
USPC . 451/5, 36, 37, 57, 103, 113; 252/79.1–79.5, 252/182.11
See application file for complete search history.

(56) References Cited

U.S. PATENT DOCUMENTS

| | | | | |
|---|---|---|---|---|
| 2,951,096 | A * | 8/1960 | Miller | 570/125 |
| 4,780,993 | A * | 11/1988 | DeSpain et al. | 451/36 |
| 5,041,304 | A * | 8/1991 | Kusano et al. | 427/535 |
| 6,120,361 | A * | 9/2000 | Konishi et al. | 451/287 |
| 6,458,017 | B1 * | 10/2002 | Li et al. | 451/28 |
| 6,761,617 | B2 | 7/2004 | Tozawa | |
| 2002/0093002 | A1 * | 7/2002 | Tsuchiya et al. | 252/79.1 |
| 2003/0126727 | A1 | 7/2003 | Tozawa | |

FOREIGN PATENT DOCUMENTS

| | | | |
|---|---|---|---|
| JP | 56-16677 | | 2/1981 |
| JP | 3-180500 | | 8/1991 |
| JP | 5-287496 | | 11/1993 |
| JP | 9-174414 | | 7/1997 |
| JP | 9-277735 | | 10/1997 |
| JP | 10-118940 | | 5/1998 |
| JP | 11-140431 | | 5/1999 |
| JP | 2947270 | | 7/1999 |
| JP | 11329896 | * | 11/1999 |
| JP | 11-350200 | * | 12/1999 |
| JP | 2000-071164 | * | 3/2000 |
| JP | 2001-123299 | | 5/2001 |
| JP | 01/74985 | | 10/2001 |
| JP | 2002-121542 | | 4/2002 |
| JP | 2002-254278 | | 9/2002 |

OTHER PUBLICATIONS

Supplementary European Search Report mailed Sep. 24, 2007 for European Application No. 03810588.

* cited by examiner

*Primary Examiner* — Robert Scruggs
(74) *Attorney, Agent, or Firm* — Wenderoth, Lind & Ponack, L.L.P.

(57) ABSTRACT

A surface-treating process and a forming process in which an inner surface of a vacuum member is mechanically polished in the presence of a liquid medium including no hydrogen atom.

12 Claims, 6 Drawing Sheets

SURFACE TREATMENT METHOD FOR VACUUM MEMBER

This application is a U.S. national stage of International Application No. PCT/JP2003/014039 filed Oct. 31, 2003.

TECHNICAL FIELD

The present invention relates to a surface-treating process for a vacuum member achieving an object to enhance a performance of a vacuum member employed in all the fields of medicine, engineering, agriculture and others; to an electrolytic polishing solution used in the process; to a forming method such as cutting-off, surface cutting, deep drawing or pressing; and to a superconducting accelerating cavity and other vacuum vessels and pipes, obtained by means of the forming method and the surface treatment in combination.

BACKGROUND ART

While development has been advanced on many kinds of vacuum members such as vacuum parts represented by a vacuum vessel or pipes with which a vacuum system is constructed, a demand for an ultra high vacuum at a higher level, in recent years, has been increasingly enhanced in the field of this kind along with increase in new demands for a charged particle accelerator, a thin film forming apparatus, a surface analyzer and others. Furthermore, in a superconducting accelerating cavity employing niobium as a structural material thereof, it has been raised a demand for an accelerating cavity showing a high Q-value under ultra high vacuum in a high accelerating electric field, that is a so-called high performance accelerating cavity, and it has also been desired to reduce a construction cost of an accelerator and a running cost thereof since, in such a situation, the accelerator has a tendency to require higher energy in operation and in turn, a larger scale in itself, leading to requirement for a number of vacuum members including an accelerating cavity and others.

In order to realize a super-high vacuum state of vacuum members, required is at least a high vacuum degree in the range from about $133.322\times10^{-7}$ to about $133.322\times10^{-9}$ Pa ($10^{-7}$ to $10^{-9}$ torr) or not more than the range. Actually, however, a gasifiable component adsorbed on and occluded as a solid solution in an inner surface of a vacuum member is outdiffused and separated from a surface and an inner surface thereof when evacuation is started and gradually released into a vacuum system, which lowers an ultimate vacuum degree. On the other hand, in a case of an accelerating cavity, hydrogen occluded as a solid state raises a surface resistance of the inside of the member, having resulted in a problem that sufficient performance in accelerating a particle cannot be obtained. Gasifiable components adsorbed and occluded as a solid solution usually include nitrogen, carbon monoxide, water and the like in addition to hydrogen, while hydrogen is a main component of about 90% in content of a total of the gases. Especially, in a superconducting accelerating cavity, hydrogen is occluded as a solid solution in the vicinity of a surface layer, very close thereto, to thereby form niobium hydride during cooling and increase a surface resistance and to invoke reduction in acceleration performance. Accordingly, it has been required to develop a technique to reduce hydrogen and water adsorbed on and occluded as a solid solution in an inner surface of a vacuum member to the lowest possible level. Note that the term "an inner surface of a vacuum member" means a surface and a bulk region in the vicinity of a surface layer of a vacuum member.

A material of a vacuum member is subjected to various kinds of forming techniques such as cutting, bending, press working, bulging, electron beam welding and others. A strain, a damage, a surface wrinkle, embedding of foreign matter or the like generated in the forming steps cause various kinds of surface defective layer including a work-affected layer and others on or in an inner surface of a vacuum member, leading to not only an adverse influence on a vacuum degree but also increase in surface resistance in application to high frequency. Therefore, it has been common that such a surface defective layer is applied with mechanical polishing, electrochemical polishing (hereinafter, also referred to as electrolytic polishing) or chemical polishing to thereby render an inner surface of a vacuum member smooth and clean.

Especially in a case where a vacuum member is a superconducting accelerating cavity, insufficient smoothness and cleanliness of an inner surface of the vacuum member exerts, naturally, an adverse influence on a vacuum degree and causes an increase in surface resistance of the member, thereby disabling a stable accelerating electric field and a high Q-value to be acquired. Therefore, after a mechanical polishing is applied onto an inner surface of the cavity, electrolytic polishing or chemical polishing is effected thereon to thereby achieve a smooth and clean surface.

For example, described in Patent Literature 1 is that a centrifugal barrel polishing, which is one of mechanical polishing methods, is applied on an inner surface of a niobium superconducting accelerating cavity and, then, electrolytic polishing or chemical polishing is effected thereon to thereby render an inner surface of the cavity smooth and clean.

In recent years, however, it has been found that with one of the polishing techniques applied, hydrogen is occluded as a solid solution in an inner surface of a superconducting accelerating cavity, and hydrogen thus occluded as a solid solution causes an increase in surface resistance value of the cavity to thereby lower a acceleration performance or the like.

Chemical polishing usually uses concentrated phosphoric acid, concentrated nitric acid, hydrofluoric acid and the like as a polishing solution, and has an advantage that the polishing can be effected only by immersing a work piece in a solution with a high polishing speed. On the other hand, there have been recognized a problem of reduction in Q-value in a high accelerating electric field of a superconducting accelerating cavity obtained by chemical polishing in an early period and a problem of occlusion of hydrogen as a solid solution.

In electrolytic polishing, the following polishing solution are generally employed: a mixture of concentrated sulfuric acid and hydrofluoric acid, a mixture of hydrofluoric acid and butanol, and the like and a superconducting accelerating cavity obtained by electrolytic polishing has a great advantage to have no reduction in Q-value even in a high accelerating electric field. Therefore, especially in a case where a superconducting accelerating cavity is manufactured, it has generally understood that use of electrolytic polishing is advantageous over use of chemical polishing and therefore, has been increasingly adopted, in recent years, in many of institutes where a study on an accelerator is conducted. Examples of such an electrolytic polishing include electrolytic polishing described, for example, in Patent Literature 2, and the like.

Electrolytic polishing is slower in a polishing speed than chemical polishing (chemical polishing: electrolytic polishing=10 to 20:1) and requires complicated jigs. Problems have been arisen that hydrogen is occluded as a solid solution in proportion to an electrolytic polishing time, which exerts an adverse influence on characteristics of an accelerator and that vacuum annealing is required for dehydrogenation after the electrolytic polishing.

As described above, the following complicated steps have been required, for example, in a conventional manufacturing process for a superconducting accelerating cavity as a vacuum member: (i) various kinds of forming, (ii) mechanical polishing, (iii) chemical polishing or/and electrolytic polishing, (iv) vacuum annealing, (v) light electrolytic polishing or light chemical polishing after the vacuum annealing, and the like. Accordingly, in the present invention, no process is adopted in which hydrogen temporarily occluded as a solid solution in a member is removed by a different means such as vacuum annealing and, instead, occlusion as a solid solution of hydrogen is prevented, before actually being occluded as a solid solution, in a process in which the member is formed and polished, and a technique of this kind has not been known at all thus far to the public. With a surface-treating process according to the present invention adopted, occlusion as a solid solution of hydrogen in a forming step and a surface treating step of polishing is blocked or extremely alleviated; therefore, the following steps are not necessary altogether: (iv) vacuum annealing and (v) electrolytic polishing or a chemical polishing conducted in succession to the vacuum annealing. Accordingly, since a manufacturing process for a vacuum member, especially a superconducting accelerating cavity, can be made greatly simpler, the present invention can be said an industrially extremely useful technique capable of reducing a manufacturing cost. Furthermore, the present inventors have discovered that by applying electrolytic polishing after mechanical polishing, hydrogen is occluded as a solid solution in a vacuum member even during electrolytic polishing. There has been no knowledge thus far of a technique realizing prevention of occlusion of hydrogen as a solid solution into a vacuum member during mechanical polishing or electrolytic polishing. With a surface-treating process according to the present invention adopted, it is possible to suppress occlusion of hydrogen as a solid solution into a vacuum member not only during mechanical polishing but also during electrolytic polishing following the mechanical polishing; therefore, a superconducting accelerating cavity can be made of a high performance and in addition thereto, vacuum annealing after the polishing can be unnecessary.

Patent Literature 1:

Japanese Unexamined Patent Publication No. 2000-71164

Patent Literature 2:

Japanese Patent No. 2947270.

DISCLOSURE OF THE INVENTION

It is an object of the present invention to provide a novel surface-polishing process for a vacuum member, realizing a high performance vacuum member at a low cost. To be more concrete, it is an object of the present invention to provide a novel surface-polishing process for a vacuum member capable of enhancing at a low cost a performance of the vacuum member by suppressing occlusion of hydrogen as a solid solution into an inner surface of the vacuum member, which deteriorates an ultimate vacuum degree and causes degradation in acceleration performance of a superconducting accelerating cavity; an electrolytic polishing solution employed in the process; and the vacuum member such as a superconducting accelerating cavity obtained by means of the process.

The present inventors have conducted intensive studies in order to solve the problem in the prior art to make clear a fact that in cases where various kinds of mechanical forming with a liquid as a medium are carried out on a vacuum member, hydrogen is occluded as a solid solution in an inner surface of the vacuum member. Furthermore, the present inventors have achieved, based on the fact, novel findings that by employing a liquid composed of materials in any of which absolutely no hydrogen atom is included in a molecular structure thereof as a liquid medium in each of all of mechanical forming processes, it is possible to prevent occlusion of hydrogen as a solid solution into the vacuum member.

Note that included in mechanical forming in the present invention are mechanical polishing and various kinds of forming techniques for manufacturing a vacuum member through physical actions such as cutting, deep drawing, pressing, bending, bulging, electron beam welding and the like from various kinds of materials.

The present inventors of the present invention have further found, based on the above findings, novel findings that by mechanically polishing an inner surface of a vacuum member in the presence of an oxidizing material and a liquid medium including no hydrogen, occlusion of hydrogen as a solid solution into the vacuum member can be conspicuously prevented even during the mechanical polishing and, in addition, during an electrolytic polishing thereafter.

That is, the present inventors have conducted many experiments to make clear the reason why by applying mechanical polishing and then electrolytic polishing to a vacuum member, a number of hydrogen is occluded as a solid solution into an inner surface of the vacuum member during the electrolytic polishing.

The present inventors have further found novel findings that by using a liquid medium including no hydrogen atom and mixed in advance with an oxidizing material during mechanical polishing, an oxide film is formed immediately on a fresh polished surface to thereby, enable occlusion of hydrogen as a solid solution into a vacuum member to be substantially prevented even in an electrolytic polishing step in which no oxidizing material is used and which follows the mechanical polishing. That is, formation of the oxide film is extremely useful not only in mechanical polishing but also in subsequent electrolytic polishing or chemical polishing in order to prevent the occlusion of hydrogen as a solid solution.

The present inventors have further found novel findings that by mechanically polishing an inner surface of a vacuum member in the presence of a liquid medium including no hydrogen atom, followed by electrolytic polishing the inner surface of the vacuum member with an electrolytic solution including an oxidizing material, occlusion of hydrogen as a solid solution into the vacuum member can be greatly reduced not only during mechanical polishing but also during electrolytic polishing.

The present inventors have completed the present invention based on the various findings described above with an additional investigation.

That is, the present invention is directed to:

(1) A surface-treating process, wherein an inner surface of a vacuum member is mechanically polished in the presence of a liquid medium including no hydrogen atom.

(2) A surface-treating process according to the (1), wherein the liquid medium including no hydrogen atom is a liquid at an ordinary temperature and an ordinary pressure and a saturated or unsaturated hydrocarbon in a molecule of which a hydrogen atom or hydrogen atoms are all substituted with a fluorine atom or fluorine atoms.

(3) A surface-treating process according to the (1), wherein the vacuum member is made of one kind or two or more kinds selected from the group consisting of niobium, titanium, stainless steel, copper, aluminum and iron.

(4) A surface-treating process according to the (1), wherein the vacuum member is made of niobium.

(5) A surface-treating process according to the (1), wherein the vacuum member is a superconducting accelerating cavity.

(6) A surface-treating process according to the (1), wherein the mechanical polishing is performed in the presence of an oxidizing material.

(7) A surface-treating process according to the (6), wherein the oxidizing material is ozone, a mixture of ozone and oxygen, or hydrogen peroxide water.

(8) A surface-treating process according to the (1), wherein after the mechanical polishing, the inner surface of a vacuum member is subjected to chemical polishing or electrochemical polishing.

(9) A surface-treating process according to the (1), wherein after the mechanical polishing, the inner surface of a vacuum member is subjected to electrochemical polishing using an electrolytic solution including an oxidizing material.

(10) A surface-treating process according to the (9), wherein the oxidizing material is ozone, hydrogen peroxide water or nitric acid.

(11) A forming process for a vacuum member, wherein the vacuum member is mechanically formed in the presence of a liquid medium including no hydrogen atom.

(12) A vacuum member obtained by means of a surface-treating process according to the (1) or a forming process according to the (11).

(13) A vacuum member according to the (12) being a superconducting accelerating cavity.

(14) An electrolytic polishing solution including an oxidizing material and used in electrochemical polishing of a vacuum member.

Occlusion of hydrogen as a solid solution into a vacuum member can be prevented (i) by applying forming such as cutting and others to or mechanically polishing to a vacuum member in the presence of a liquid medium including no hydrogen atom; (ii) by mechanically polishing an inner surface of a vacuum member in the presence of an oxidizing material and a liquid medium including no hydrogen atom; (iii) by mechanically polishing an inner surface of a vacuum member in the presence of a liquid medium including no hydrogen atom and then subjecting the inner surface thereof to electrochemical polishing using an electrolytic solution including an oxidizing material; (iv) by mechanically polishing an inner surface of a vacuum member in the presence of a liquid medium including no hydrogen atom, preferably, together with an oxidizing material and then subjecting the inner surface thereof to electrolytic polishing; or (v) by mechanically polishing an inner surface of a vacuum member in the presence of a liquid medium including no hydrogen atom and then chemically polishing the inner surface thereof, thereby enabling manufacture of the vacuum member such as a superconducting accelerating cavity with a high acceleration performance even without implementing vacuum annealing and the like which works as factors causing increase in manufacturing cost, reduction in mechanical strength of the vacuum member and recontamination on the inner surface thereof.

Figure 1:
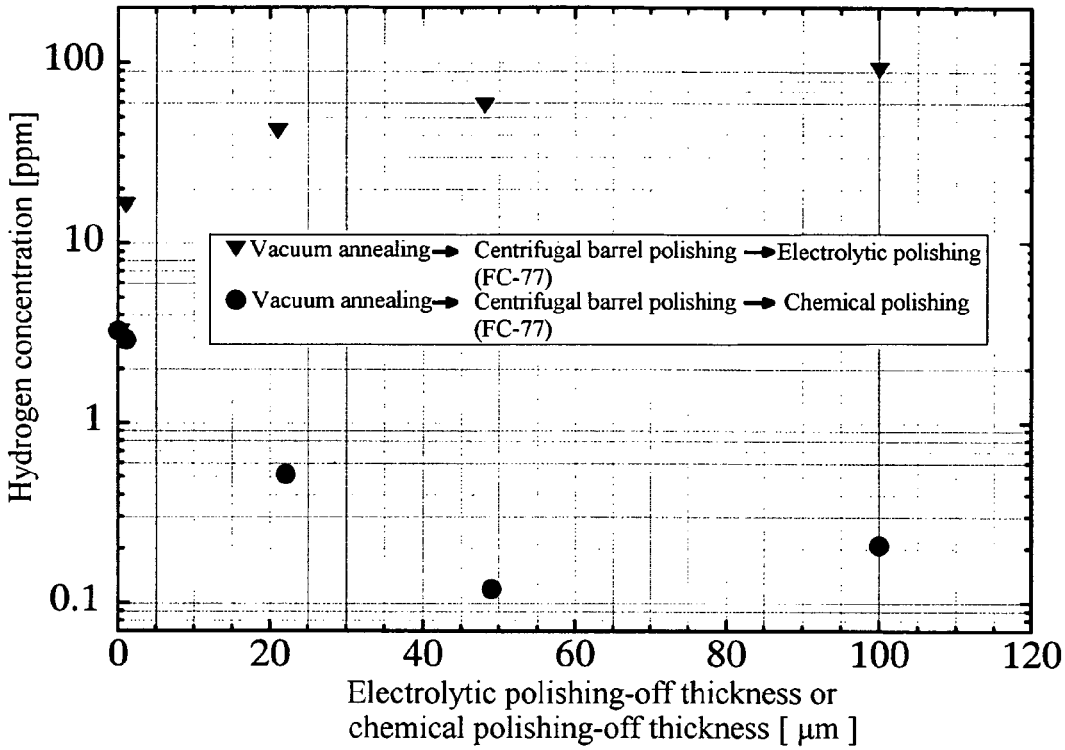
FIG. 1 is a graph showing a relationship between a polishing-off thickness during chemical polishing or electrolytic polishing applied on a plate-shaped niobium sample according to Test Example 4 and a hydrogen concentration in the plate-shaped niobium sample at the polishing-off thickness.

In the figures, the reference numeral 1 is a revolution shaft; 2, a support; 3, a fixed table; 4, a gear; 5, a motor; 6, a gear; 7, a rotary table; 8, a vacuum member; 9, a polishing medium; 10, vacuum member; 11, a support; 12, a motor; 13, a vacuum member holding metal member; 14*a* and 14*b*, sleeves; 15, a liquid feed pipe; 16*a* and 16*b*, cathode terminals; 17*a* and 17*b*, carbon brushes; 18*a* and 18*b*, a liquid return pipe; 19, an internal pressure control port; 20, an exhaust port; 21, a liquid feed port; 22, a polishing liquid; 23, a spur gear; 24, a spur gear; 25, a waste liquid port; and 26, a hydraulic cylinder.

BEST MODE FOR CARRYING OUT THE INVENTION

Hereinafter, description will be given of preferred embodiments of the present invention.

A material of a vacuum member such as a metal exemplified as niobium, titanium, a stainless steel, copper, aluminum or iron, an alloy exemplified as one of the metals, or a product plated with one of the metals is subjected to a method such as bending, press working, electron beam welding or the like to form the material into a shape of a target vacuum member, followed by, for example, mechanical polishing on an inner surface of the formed member so as to make the inner surface thereof smooth. Hereinafter, description will be given of a preferred embodiment of mechanical polishing.

No specific limitation is placed on an apparatus used in mechanical polishing and a known apparatus may be employed. For example, in a case of a superconducting accelerating cavity, it is especially preferable to employ a centrifugal barrel polishing apparatus in view of the working efficiency though a barrel polishing apparatus or the like can also be employed. An centrifugal barrel polishing apparatus is constructed and operated in a way such that a vacuum member placed on the apparatus is rotated about its axis and the vacuum member is revolved round a revolution shaft, as a center, spaced apart from the rotation axis of the vacuum member in a direction opposite the direction of the rotation to thereby, an inner surface of the vacuum member is physically polished at a high speed.

Figure 2:
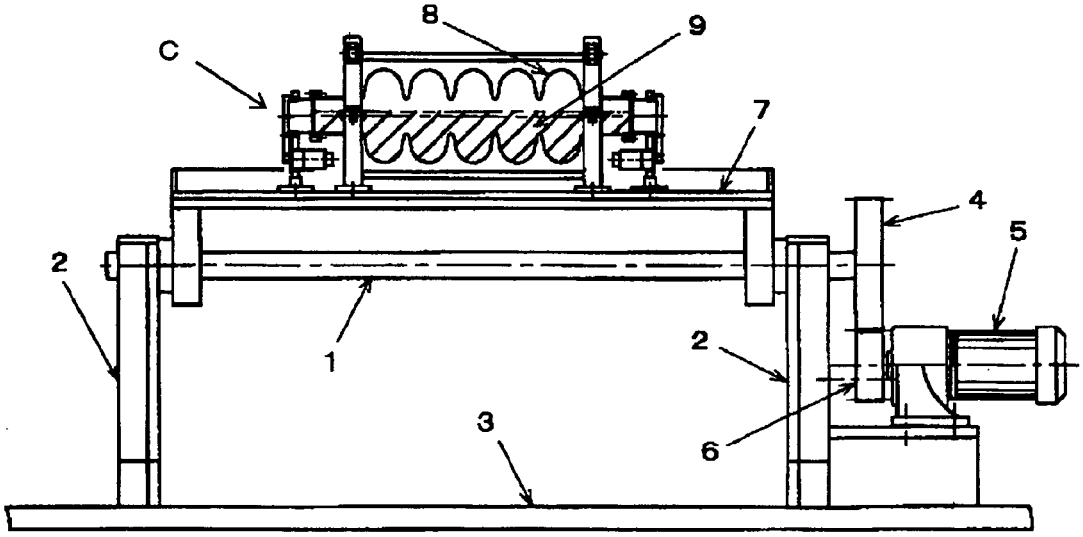
FIG. 2 is a front view showing an overall construction of one example of a centrifugal barrel polishing apparatus for implementing preferred mechanical polishing in the present invention.
Figure 3:
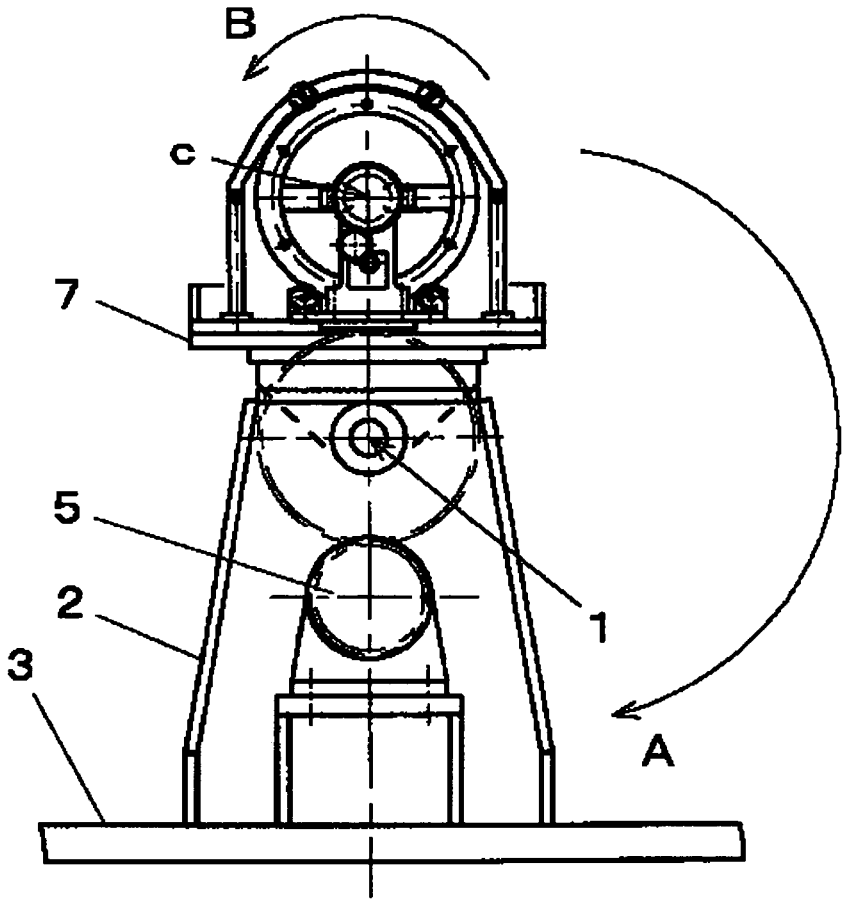
FIG. 3 is aright side view showing the overall construction of one example of a centrifugal barrel polishing apparatus for implementing preferred mechanical polishing in the present invention.

FIGS. 2 and 3 are a front view and a right side view, respectively, showing an overall construction of one example of an apparatus for implementing centrifugal barrel polishing. In the figures, a reference numeral 1 is a revolution shaft, the revolution shaft 1 is rotatably supported by a pair of supports 2 at sites in the vicinity of both ends, in the length direction, of the shaft and extended across the supports 2 above a fixed table 3 in a horizontal direction. A reference numeral 8 is a vacuum member and a reference numeral 9 is a polishing medium with which the vacuum member is filled half way. A gear 4 is mounted at one end of the revolution shaft in the length direction, which receives a torque from a gear 6 mounted to a motor 5. A rotary table 7 is mounted to the revolution shaft 1. The revolution shaft 1 is rotated by rotation of the motor 5 to, then, revolve the rotary table 7 round the revolution shaft 1 as a center as shown with an arrow mark A of FIG. 3 while being kept a large space from the revolution shaft 1. An arrow mark B is a direction of the rotation of a cavity member being set in a direction opposite the revolution direction. A reference letter C is the rotation axis of the cavity member.

In a case where mechanical polishing such as centrifugal barrel polishing is performed, polishing chips are charged into an inside space of a vacuum member as polishing materials. Polishing chips are not specifically limited and may be any kind sold on the market. Examples thereof include products manufactured by TKX Corporation with trade names of GCT, PK-10, SPT, GRT and the like and it is preferable in the present invention to use polishing chips with a high polishing speed or efficiency containing silicon carbide (SiC), for example, the product with the trade name GCT or the like. Note that while mechanical polishing may be performed with the polishing chips only charged, mechanical polishing with polishing chips only is not practical in consideration of a polishing efficiency and prevention of heat generation during polishing. Therefore, it is preferable to perform mechanical polishing with polishing chips and a liquid medium (a coolant) charged simultaneously inside the vacuum member.

A liquid medium used in the present invention is a liquid medium including no hydrogen atom and may be either of a single compound or of a mixture composed of two or more kinds of compounds, and no specific limitation is imposed on a particular one of liquid media, wherein any of liquid media can be employed as far as each of all materials of which the liquid medium is composed includes absolutely no hydrogen atom in molecular structure thereof. However, a small amount of a chemical compound including a hydrogen atom (for example, water) may be included as far as the chemical compound with such a small amount does not hinder the effect of the present invention. Examples of liquid media including no hydrogen atom include $CCl_3F$, $CCl_2F_2$, $CClF_3$, $C_2Cl_3F_3$, $C_2Cl_2F_4$, $CF_4$, $CBrF_3$, $C_2F_4Br_2$, $C_4F_8$ (Freon (R)) and tetrabromocarbon, all of which is a liquid under pressure, while preferable in terms of operability is a liquid medium in a state of a liquid at ordinary temperature and ordinary pressure. Examples thereof include a saturated or unsaturated hydrocarbon that is a liquid at ordinary temperature and ordinary pressure, and in which all hydrogen atoms are replaced with fluorine atoms, especially a fluorine containing organic solvent expressed by a general formula of $C_nF_m$ (preferably n is an integer from 6 to 12), and to be concrete, preferable are Fluorinert™ fluorine containing inert liquid (Fluorinert™) FC-77(a mixture of $C_8F_{16}O$ and $C_8F_{18}$), FC84 ($C_7F_{16}$), FC72 ($C_6F_{14}$) and the like, all manufactured by 3M Co. Note that this is because the present inventors have made clear that generally, a liquid medium is used in mechanical polishing, and in a case where adopted is water or a mixture of water and a surfactant having been conventionally used as a liquid media, hydrogen is occluded as a solid solution into a vacuum member during mechanical polishing.

The present invention employs a liquid medium including no hydrogen atom as a liquid medium used in the mechanical polishing, in which case it is more preferable that an oxidizing material is additionally included in the liquid medium to thereby perform mechanical polishing in the co-existence with an oxidizing material.

No specific limitation is imposed on an oxidizing material used in mechanical polishing of the present invention and any of oxidizing materials, of either a liquid or a gas and either alone or in mixture, may be used as far as the materials are miscible into a liquid medium with ease, among which preferable in terms of operability is a compound in the state of a gas or a liquid decomposable at temperatures in the vicinity of room temperature, for example ozone (including ozone water), hydrogen peroxide water or the like. A case arises where an oxidizing material and a liquid medium including no hydrogen atom are either miscible or inmiscible inside a vacuum member. A mixing ratio of an oxidizing material to a liquid medium is usually in the range from 0.01 to 50 to from 99.99 to 50 and preferably in the range from 1 to 50 to from 99 to 50, while an oxidizing material can be mixed into a liquid medium up to a ratio at which the oxidizing material reaches its saturation in the liquid medium.

In mechanical polishing of the present invention, it is especially preferable to use ozone as an oxidizing material. In this case, ozone is not specifically limited in purity, while it is preferable in terms of operability to generate ozone by an ozonizer or the like and to use a mixture of ozone and oxygen containing 1 to 40 mass % of ozone relative to the mass of oxygen. Mechanical polishing of the present invention is preferably performed in such a way that an oxidizing material such as ozone or the like is absorbed into a liquid medium and mixed therein, which is followed by replacement of an atmosphere inside the vacuum member subjected to mechanical polishing with the oxidizing material. This is because an oxide film (a protective film) is immediately formed on a fresh polished surface of the member by an active oxygen originating from the oxidizing material to prevent occlusion of hydrogen as a solid solution into an inner surface of the member during not only a mechanical polishing step, but also an electrolytic polishing step performed successively thereto.

Therefore, by mechanically polishing a vacuum member using an oxidizing material and a liquid medium including no hydrogen atom in mechanical polishing, an oxide film (a protective film) obtained by oxygen originating from the oxidizing material is formed on a surface of the vacuum member, thereby enabling prevention of occlusion of hydrogen as a solid solution into an inner surface of the vacuum member during the mechanical polishing and a polishing step subsequent thereto. That is, vacuum annealing or the like after the polishing step is unnecessary altogether and it is possible to provide a high performance vacuum member, especially a superconducting accelerating cavity, showing a high Q-value under a high accelerating electric field.

No specific limitation is imposed on occupancy volumes of polishing chips and a liquid medium inside a vacuum member, a rotational speed and a rotation number of a centrifugal barrel, whether or not a direction of rotation is reversed at given intervals and the like in a case where centrifugal barrel polishing is adopted as mechanical polishing, and such parameters may be set properly in adaptation for a material, a shape, a polished-off thickness (μm) and others of a vacuum member to be polished as objectives.

It is preferable that a vacuum member to which mechanical polishing has been applied is further polished by means of an electrolytic polishing alone or chemical polishing alone; or chemical polishing combined with electrolytic polishing to follow the chemical polishing. After the chemical polishing and electrolytic polishing end, the polishing liquid is immediately discharged from the vacuum member, followed by cleaning the inside of the vacuum member.

Then, description will be given of chemical polishing. After chemical polishing is applied following mechanical polishing, a material contaminating the inside of a vacuum member, such as polishing particles, produced in mechanical polishing is removed by means of chemical polishing, thereby, in addition, enabling an inner surface of the vacuum member to be smoothed. Hereinafter, description will be given of a preferred embodiment of chemical polishing. No specific limitation is imposed on a chemical polishing process and chemical polishing may be implemented in a way such that either the whole of a vacuum member is immersed into a polishing solution or is the polishing solution poured into the inside of the vacuum member as a vessel. Examples of chemical polishing solutions usually include: a mixed solution containing phosphoric acid, hydrofluoric acid, nitric acid and water; and a mixed solution containing the same constituents except that sulfuric acid is contained instead of phosphoric acid. In the present invention, a process described in Japanese Unexamined Patent Publication No. 2000-294398 is also preferably adopted in which an axis of a cavity of a vacuum member is held in parallel to the ground surface and, in this state, a temperature controlled polishing solution is caused to flow from one opening section to the other opening section while the vacuum member is turned in a circumferential direction to thereby polish the cavity.

Figure 4:
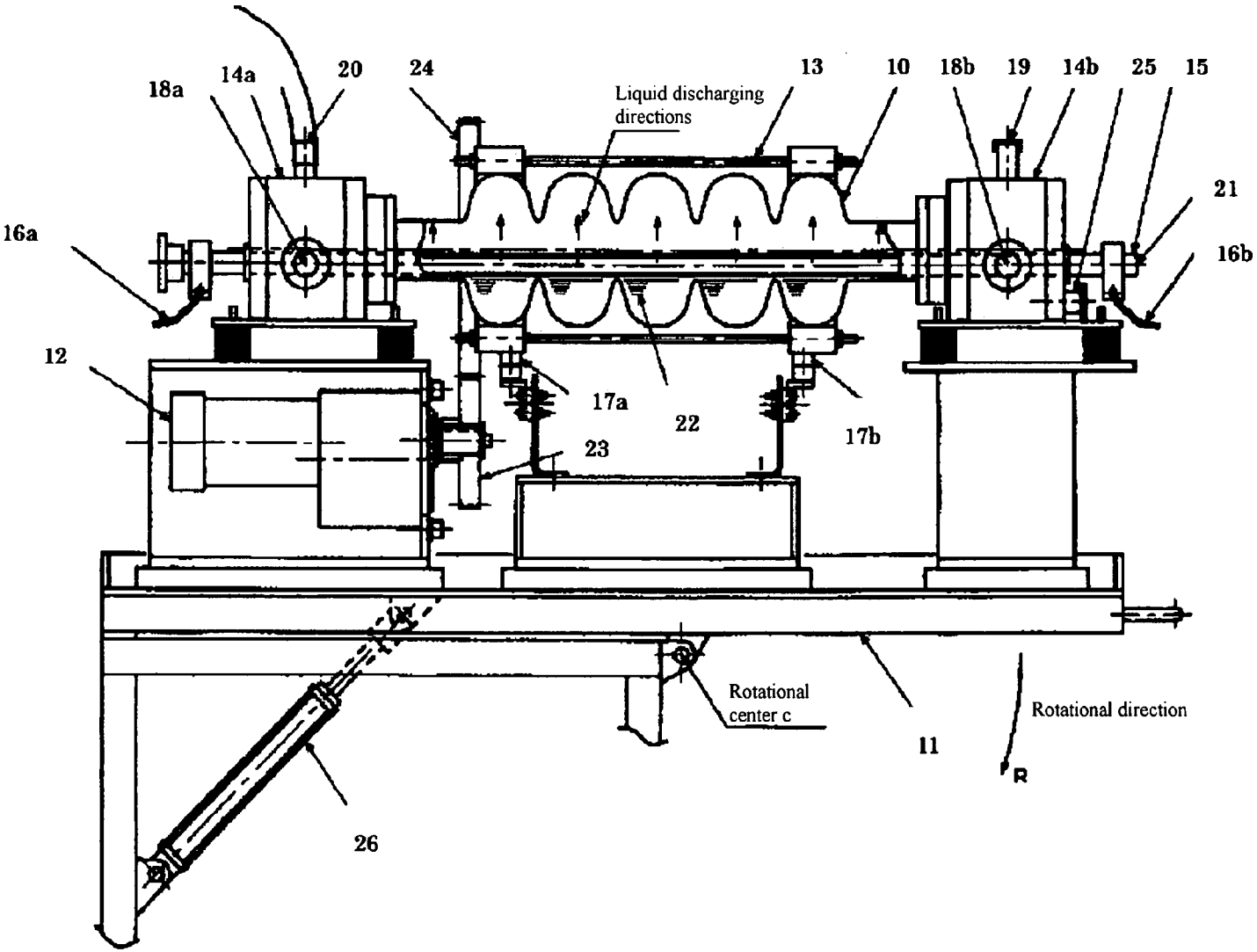
FIG. 4 is a view showing one example of an apparatus implementing preferable chemical polishing or electrolytic polishing in the present invention.

FIG. 4 shows one example of an apparatus for implementing preferable chemical polishing or/and electrolytic polishing, described below, in the present invention. This apparatus is an apparatus disclosed in Japanese Unexamined Patent Publication No. 2000-294398 and, in the figure, a reference numeral 10 is a vacuum member; 11, a support table; 12, a motor; 13, a vacuum member holding metal member; 14*a* and 14*b*, sleeves; 15, a liquid feed pipe; 18*a* and 18*b*, liquid return pipes; 19, an internal pressure control port; 20, an exhaust port; 21, a liquid feed port; 22, a polishing solution; 23 and 24, spur gears; 25, a waste liquid port; and 26, a hydraulic cylinder. The reference letters 16*a* and 16*b*, and 17*a* and 17*b* are cathode terminals and carbon brushes used not for chemical polishing but for electrolytic polishing. A vacuum member is set in the member holding metal member 13 and, in the state, chemical polishing or/and electrolytic polishing are preferably performed.

For example, an apparatus described in Japanese Patent No. 2947270 and the like are exemplified as apparatuses for performing electrolytic polishing, which is preferable in the present invention.

Electrolytic polishing is preferably carried out in the following way: for example, an opposite electrode (cathode) of aluminum is inserted into the inside of a vacuum member and an electrolytic polishing solution is caused to flow from an opening section in one direction of the vacuum member in a similar way to that in a case of chemical polishing and in the state, the vacuum member works as an anode to dissolve and remove an inner surface thereof.

A preferable electrolytic solution employed in the present invention is an electrolytic polishing solution containing an oxidizing material and may include a compound containing hydrogen such as water because of the presence of the oxidizing substance. Alterations may be made according to a metal material to be polished, polishing conditions and the like. Exemplified as oxidizing materials are nitric acid, ozone, hydrogen peroxide water and the like, among which more preferable is a material including no hydrogen in molecular structure thereof. A content of nitric acid in an electrolytic polishing solution in a case where nitric acid is employed as an oxidizing material is preferably in the range from 0.001 to 5.0 vol % of nitric acid with a purity of 67 wt % and more preferably in the range from 0.02 to 1.0 vol % of nitric acid with a purity of 67 wt % relative to a total of the electrolytic polishing solution. The presence of nitric acid prevents occlusion of hydrogen as a solid solution into a vacuum member during electrolytic polishing to render subsequent operations such as vacuum annealing and the like unnecessary, thereby enabling a high performance vacuum member to be provided.

The reason why a content of an oxidizing material in an electrolytic solution is preferably in the range is that the content equal to or less than the lower limit of the range disables an especially excellent effect preventing occlusion of hydrogen as a solid solution into a vacuum member to be expected, while the content equal to or more than the upper limit of the range, in a case where nitric acid is employed as an oxidizing material, causes chemical polishing in parallel to electrolytic polishing; therefore, a polishing-off thickness (a surface removal thickness of the vacuum member by polishing) is hard to be grasped quantitatively.

Below presented are preferable examples of chemical polishing solutions and electrolytic polishing solutions according to kinds of metal materials employed in a vacuum member and preferable examples of polishing conditions in cases where the polishing solutions are employed, to which electrolytic solutions and polishing conditions employed in the present invention are not specifically limited. Note that in the following description, employed are 89 w/v % phosphoric acid, 40 w/v % hydrofluoric acid, 98 w/v % sulfuric acid and 67 w/v % nitric acid.

(Examples of Chemical Polishing Solution in a Case Where the Material of a Vacuum Member is Niobium)

| | | |
|---|---|---|
| A. | Phosphoric acid: | 20 to 40 vol % |
| | Hydrofluoric acid: | 20 to 40 vol % |
| | Nitric acid: | 20 to 40 vol % |
| | Temperature: | 10 to 50° C. |

-continued

| | | |
|---|---|---|
| B. | Sulfuric acid: | 25 to 45 vol % |
| | Hydrofluoric acid: | 20 to 40 vol % |
| | Nitric acid: | 25 to 40 vol % |
| | Temperature: | 10 to 50 vol % |

(Example of Chemical Polishing Solution in a Case Where the Material of a Vacuum Member is Aluminum)

| | | |
|---|---|---|
| A. | Phosphoric acid: | 45 to 85 vol % |
| | Sulfuric acid: | 0 to 40 vol % |
| | Nitric acid: | 2 to 40 vol % |
| | Acetic acid: | 0 to 15 vol % |
| | Temperature: | 90 to 120° C. |
| B. | Antimony difluoride: | 100 to 200 g/L |
| | Nitric acid: | 100 to 170 g/L |
| | Temperature: | 50 to 80° C. |

(Example of Chemical Polishing Solution in a Case Where the Material of a Vacuum Member is Stainless Steel)

| | |
|---|---|
| Condensed phosphoric acid: | 100 vol % |
| Water: | 0 to 10 vol % |
| Temperature: | 150 to 200° C. |

(Examples of Chemical Polishing Solution in a Case Where the Material of a Vacuum Member is Copper or an Alloy Thereof)

| | |
|---|---|
| Phosphoric acid: | 30 to 80 vol % |
| Nitric acid: | 5 to 20 vol % |
| Glacial acetic acid: | 10 to 50 vol % |
| Water: | 0 to 10 vol % |
| Temperature: | 55 to 80° C. |

(Example of Electrolytic Polishing Solution in a Case Where the Material of a Vacuum Member is Niobium)

| | |
|---|---|
| Sulfuric acid: | 80 to 90 vol % |
| Hydrofluoric acid: | 10 to 20 vol % |
| Nitric acid: | 0.001 to 1.0 vol % |
| Anode current density: | 10 to 90 mA/cm$^2$ |
| Temperature: | 10 to 50° C. |

(Example of Electrolytic Polishing Solution in a Case Where the Material of a Vacuum Member is Copper or an Alloy Thereof)

| | |
|---|---|
| Phosphoric acid: | 500 to 800 ml/L |
| Chromic anhydride: | 50 to 150 g/L |
| Nitric acid: | 0.01 to 1.0 vol % |
| Temperature: | 20 to 40° C. |
| Anode current density: | 0.2 to 0.4 A/cm$^2$ |

(Example of Electrolytic Polishing Solution in a Case Where the Material of a Vacuum Member is Stainless Steel)

| | |
|---|---|
| Phosphoric acid: | 600 to 800 ml/L |
| Sulfuric acid: | 100 to 300 ml/L |
| Nitric acid: | 0.01 to 1.0 vol % |
| Chromic anhydride: | 10 to 30 g/L |
| Temperature: | 40 to 60° C. |
| Anode current density: | 0.1 to 0.5 A/cm$^2$ |

In order to remove a polishing solution, the inside of a vacuum member is usually cleaned. No specific limitation is imposed on a cleaning liquid and pure water or the like may be used. It has been confirmed in experiments or the like that in cleaning, no occlusion of hydrogen as a solid solution occurs into a surface of the member to which chemical polishing or electrolytic polishing has been applied. It is allowed to use a liquid including no hydrogen atom, for example FC-77 or the like described above, as a cleaning liquid.

A vacuum member (for example, a superconducting accelerating cavity) to which mechanical polishing, chemical polishing and electrolytic polishing in the present invention applied is manufactured by forming of a vacuum member material (for example, niobium, titanium, stainless steel, copper, aluminum or iron). The following forming techniques are exemplified as techniques to form a vacuum member material into a vacuum member: for example, lathing, grinding, press working, deep drawing, discharge wire cutting, milling, hydraulic bulging, cutting-off, surface cutting, bending, electron beam welding and the like. There is a case where a liquid medium (for example, a coolant) is employed for lubrication or cooling in the forming, wherein if a liquid including a constituent having hydrogen, for example water, is employed as a liquid medium, hydrogen is occluded as a solid solution even in a forming step. If a press oil or the like is employed in press working or the like, hydrogen originating from a press oil is occluded as a solid solution into the member similarly to the case described above though there is a difference at a level of occlusion of hydrogen as a solid solution. For example, while a hydrogen concentration in a niobium material from which hydrogen is once removed in vacuum annealing is in the range of about 1.0±0.2 ppm, a hydrogen concentration in the niobium material after discharge wire cut or milling is applied thereto increases to be in the range of 16.7±14 ppm or 39.9±9.9 ppm. Therefore, even in the forming, by using a liquid medium including no hydrogen atom, for example, Fluorinert™ fluorine containing inert liquid (Fluorinert™) FC-77 (a mixture of $C_8F_{16}O$ and $C_8F_{18}$), FC84 ($C_7F_{16}$), FC72 ($C_6F_{14}$) or the like, manufactured by 3M Co., it can be prevented for hydrogen to be occluded as a solid solution into an inner surface of a vacuum member.

A concentration of hydrogen occluded as a solid solution in a vacuum member such as a superconducting accelerating cavity obtained by means of the present invention is estimated preferably 20 ppm or less from numerical values obtained with a sample, as a substitute, of the same material as the vacuum member and more preferably 10 ppm or less in light of an acceleration performance of the cavity. This is because a Q-value of a superconducting accelerating cavity or the like is not conspicuously reduced in the range.

According to the present invention, occlusion of hydrogen as a solid solution into a vacuum member can be prevented (i) by applying forming such as cutting and others to or mechanical polishing to a vacuum member in the presence of a liquid medium including no hydrogen atom; (ii) by mechanically polishing an inner surface of a vacuum member in the presence of an oxidizing material and a liquid medium including no hydrogen atom; (iii) by mechanically polishing an inner surface of a vacuum member in the presence of a liquid medium including no hydrogen atom and then subjecting the inner surface thereof to electrochemical polishing using an electrolytic solution including an oxidizing material; (iv) by mechanically polishing an inner surface of a vacuum member in the presence of a liquid medium including no hydrogen atom, preferably, together with an oxidizing material and then subjecting the inner surface thereof to electrolytic polishing; or (v) by mechanically polishing an inner surface of a vacuum member in the presence of a liquid medium including no hydrogen atom and then subjecting the inner surface thereof to chemically polishing, thereby enabling manufacture of the vacuum member such as a superconducting accelerating cavity with a high performance even without implementing vacuum annealing and the like which works as factors causing increase in manufacturing cost of the vacuum member, reduction in mechanical strength thereof and recontamination on the inner surface thereof.

EXAMPLES

While detailed description will be given of the present invention showing examples and the like below, needless to say that the present invention is not limited to the following examples and various embodiments can be implemented.

Description will be given of numerical measurements in test examples and examples.

A total polishing-off thickness (μm) of an inner surface of a vacuum member may be obtained in a procedure in which a weight of the member is measured in advance, the member after polishing is cleaned and dried, then weighed and a difference between weights before and after the polishing is converted to a polishing-off thickness or may be directly measured with an ultrasonic film thickness meter or the like. An amount of hydrogen occluded as a solid solution in the inside of the vacuum member was indirectly obtained in a procedure in which polishing similar to that applied to the vacuum member is applied to a plate-shaped sample, as a substitute, of the same material as that of the vacuum member and an amount of hydrogen released from the sample by heat melting is measured. Note that an accelerating electric field (Eacc: MV/m) and a Q-value of the accelerating cavity are calculated from measurements of powers of incidence, reflection and transmit, a resonant frequency and a decay time (a time in which transmit decreases to half an incident light intensity after the incident light is interrupted) of RF (radio frequency) in the cavity. Note that Eacc in the figure indicates an accelerating electric field of an accelerating cavity, $Q_0$ indicates a Q-value in inverse proportion to a surface resistance, wherein with the larger values, an acceleration performance is better.

Test Example 1

Comparative Investigation on Occlusion of Hydrogen as a Solid Solution According to a Kind of a Liquid Medium in Centrifugal Barrel Polishing Dehydrogenation of an L band niobium single cell cavity (a length of 370 mm and the maximum diameter of 210 mm) was conducted by applying vacuum annealing at 750° C. for 3 hours thereto. Inserted into the cavity was a plate-shaped niobium sample (a thickness of 2.5 mm, a width of 1 mm and a length in the range from 147 to 149 mm, which is also simply referred to as a sample) dehyrogenated in a similar way and thereafter an inner surface of the cavity and the niobium sample were subjected to centrifugal barrel polishing using Fluorinert™ fluorine containing inert liquid (Fluorinert™) FC-77 (a mixture of $C_8F_{16}O$ and $C_8F_{18}$) manufactured by 3M Co. as a liquid medium with a resulted average polishing-off thickness of about 30 μm. Note that a polishing-off thickness of 30 μm corresponds to a thickness of an affected layer on a surface of niobium material to be removed by the polishing judging based on experiments in the past and the rule of thumb. Centrifugal barrel polishing was performed in conditions described in Table 1 with the apparatus shown in FIGS. 2 and 3. Note that triangular prism-shaped GCT containing silicon carbide (SiC) as abrasive grains (manufactured by TKX Co.) was adopted as polishing chips. Furthermore, for comparison, prepared from the same material were a sample obtained by centrifugal barrel polishing in a dry condition without using a liquid medium, a sample obtained by centrifugal barrel polishing using a mixture of water and a surfactant as a liquid medium and a sample obtained by centrifugal barrel polishing using a hydrogen peroxide water or absolute propyl alcohol as a liquid medium.

TABLE 1

| | |
|---|---|
| Rotation number | 160 rpm |
| Revolution number | 160 rpm |
| Polishing chips | GCT |
| Amount of polishing chips | 2000 $cm^3$ |
| Amount of liquid medium | 850 ml |
| Polishing time | 4 hrs |

Measurements were conducted on polishing-off thickness of the polished niobium samples and hydrogen concentrations in the samples. A polishing-off thickness was measured with an ultrasonic film thickness meter (manufactured by NOVA Co. with a model 800+). A hydrogen concentration in a sample was measured with RH-1E method of LECO Co. (a combination of an inert gas melting method and a thermal conductivity method described in JIS-Z-2614). Results of the measurements are shown in Table 2. An average polishing-off thickness in the range from about 0 to 5 μm in a case of a dry polishing (without a liquid medium) shows almost no polishing-off on the sample in the method. From the results, it was made clear that mechanically polishing with Fluorinert FC-77 having no hydrogen atom in a molecule thereof as a liquid medium greatly suppresses occlusion of hydrogen as a solid solution into a member to be polished.

TABLE 2

| Kinds of liquid media | Hydrogen concentrations (detected values: ppm) | Polishing-off thickness (μm) |
|---|---|---|
| Water + Surfactant | 79.1 ± 5.0 | About 30 |
| None (dry) | 10.9 ± 0.8 | About 0 to 5 |
| Absolute propyl alcohol | 49.4 ± 2.2 | About 30 |
| Hydrogen peroxide water (10%) | 28.4 ± 1.4 | About 30 |
| Fluorinert FC77 | 4.6 ± 0.8 | About 30 |

Test Example 2

Figure 5:
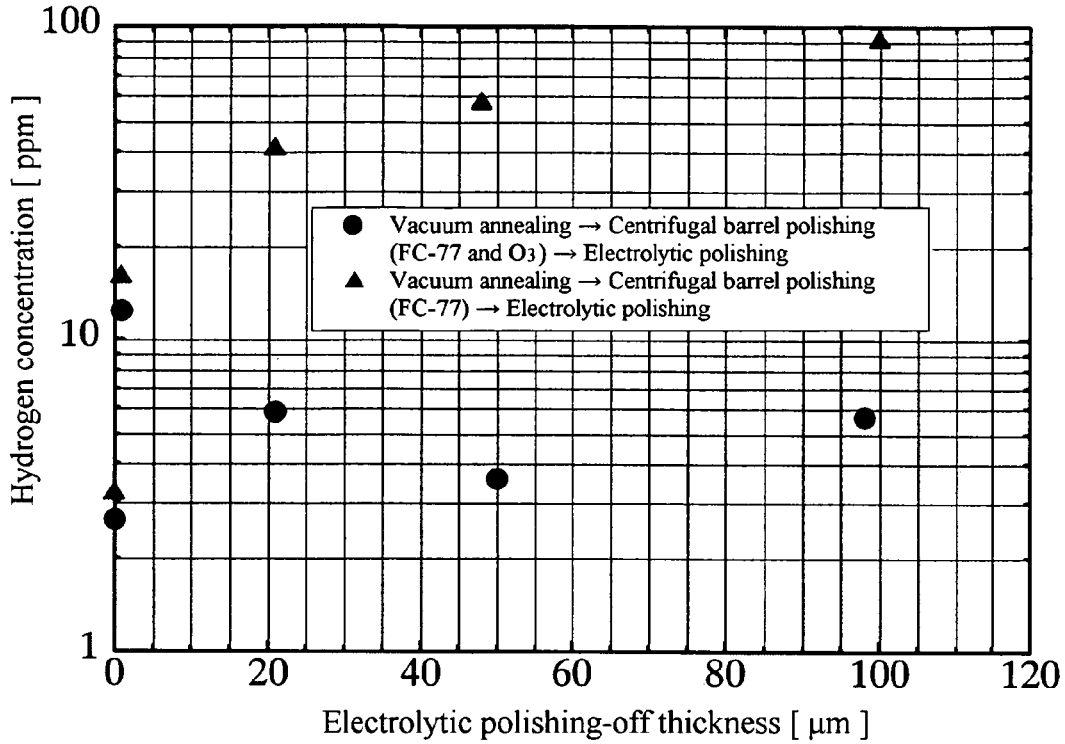
FIG. 5 is a graph showing hydrogen concentrations in niobium samples obtained by, in Test Example 2, subjecting the samples to centrifugal barrel polishing with FC-77 alone and a mixture of FC-77 and ozone included therein, respectively, as a liquid medium, followed by electrolytic polishing on the samples.

Comparative Investigation on Occlusion of Hydrogen as a Solid Solution with Ozone Contained in Liquid Medium in Centrifugal Barrel Polishing After a plate-shaped niobium sample (a thickness of 2.5 mm, a width of 1 mm and a length in the range from 147 to 149 mm), according to Test Example 1, was put into an L band niobium single cell cavity (a length of 370 mm and the maximum diameter of 210 mm) dehydrogenated by vacuum annealing, the sample was subjected to centrifugal barrel polishing with FC-77 alone or a mixture of FC-77 and ozone in which ozone is absorbed in FC-77, as a liquid medium. Hydrogen concentrations (ppm) in samples after the central barrel polishing are as shown in Table 3. The samples were further applied with electrolytic polishing to measure occlusion of hydrogen as a solid solution during electrolytic polishing. Results of the measurements are shown in FIG. 5. Note that electrolytic polishing was performed according to Test Example 1.

From Table 3, it was found that hydrogen concentrations in samples are both low, if they are subjected to centrifugal barrel polishing with FC-77 alone and mixture of FC-77 and ozone, respectively, as a liquid medium, which means that no hydrogen is occluded as a solid solution into the samples during centrifugal polishing. Further electrolytic polishing on the samples causes a distinct difference between both. That is, the sample subjected to centrifugal polishing with FC-77 alone increased an amount of hydrogen occluded as a solid solution in proportion to a polishing-off thickness during electrolytic polishing, while the sample subjected to centrifugal barrel polishing with a mixture of FC-77 and ozone as a liquid medium did not increase an amount of hydrogen occluded as a solid solution. From this result, it is found that centrifugal barrel polishing on a niobium sample in the presence of ozone and FC-77 greatly suppresses occlusion of hydrogen as a solid solution not only during centrifugal barrel polishing, but also during electrolytic polishing subsequent thereto.

TABLE 3

| Liquid media in centrifugal barrel polishing | Hydrogen concentrations (ppm) | Polishing-off thickness (μm) |
|---|---|---|
| FC-77 alone | 4.60 ± 0.8 | about 30 |
| FC-77 + ozone | 2.67 ± 0.5 | about 30 |

Test Example 3

Plate-shaped niobium samples were subjected to centrifugal barrel polishing in a similar way to that in Test Example 1. Thereafter, the samples were cleaned with Fluorinert™ FC-77. Thus obtained plate-shaped niobium samples were subjected respectively to the following after treatments including (i) vacuum annealing alone, (ii) immersion in an electrolytic polishing solution at 30° C. for 3 hours alone, (iii) after subjected to mechanical polishing in a similar way to that in Test Example 1 described above, followed by immersion in an electrolytic polishing solution at 30° C. for 3 hours, (iv) electrolytic polishing, and (v) chemical polishing, and measurements were conducted on hydrogen concentrations (ppm) in the respective samples. Chemical polishing was conducted in a way such that a plate-shaped niobium sample is immersed in a chemical polishing solution kept at 30° C. and composed of 89 w/v % phosphoric acid: 67 w/v % nitric acid: 40 w/v % hydrofluoricacid=1 vol: 1 vol: 1 vol. Electrolytic polishing was conducted in a way such that a plate-shaped niobium sample was used as an anode and a plate-shaped aluminum was used as an opposite electrode, both electrodes were immersed in an electrolytic polishing solution kept at 30° C. and composed of 98 w/v % sulfuric acid: 40 w/v % hydrofluoric acid: water=85 vol: 10 vol: 5 vol and a current was supplied at an average current density of 50 mA/cm$^2$. Not that in a case where a sample is only immersed in an electrolytic polishing solution, no current was fed.

Shown in Table 4 are results of hydrogen concentrations in the samples subjected to the respective treatments from (i) to (v). A polishing-off thickness was measured with an ultrasonic film thickness meter (manufactured by NOVA Co. with a model 800+). A hydrogen concentration in a sample was measured with RH-1E method of LECO Co. (a method of a combination of an inert gas melting method and a thermal conductivity method described in JIS-Z-2614). Almost no occlusion of hydrogen as a solid solution was observed in the samples of (ii) immersion in an electrolytic polishing solution, (iv) electrolytic polishing, and (v) chemical polishing, while a great amount of hydrogen occluded as a solid solution was observed in the sample (iii) immersed in an electrolytic polishing solution after subjected to mechanical polishing. Results of the measurements show that polishing scratches and others arise during mechanical polishing of a vacuum member and in a subsequent step, hydrogen is occluded as a solid solution due to the presence of the scratches and others.

TABLE 4

| Treatment processes | Polishing-off thickness (μm) | Hydrogen concentrations (ppm) |
|---|---|---|
| (i) As vacuum annealed | — | 1.0 ± 0.2 |
| (ii) Immersion into electrolytic polishing solution only | — | 5.8 ± 1.5 |
| (iii) Immersion into electrolytic polishing solution after mechanical polishing | — | 115.0 ± 3.4 |
| (iv) Electrolytic polishing | 50 | 5.0 ± 1.7 |
| (v) Chemical polishing | 50 | 1.0 ± 0.01 |

Test Example 4

Plate-shaped niobium samples mechanically polished in a similar way to that of Test Example 1 were cleaned with pure water, followed by chemical polishing or electrolytic polishing. Chemical polishing was conducted in a way such that a plate-shaped niobium sample is immersed in a chemical polishing solution kept at 30° C. and composed of 89 w/v % phosphoric acid: 67 w/v % nitric acid: 40 w/v % hydrofluoric acid=1 vol: 1 vol: 1 vol. Electrolytic polishing was conducted in a way such that a plate-shaped niobium sample was used as an anode and a plate-shaped aluminum was used as an opposite electrode, both electrodes were immersed in an electrolytic polishing solution kept at 30° C. and composed of 98 w/v % sulfuric acid : 40 w/v % hydrofluoric acid: water=85 vol: 10 vol: 5 vol and a current was supplied at an average current density of 50 mA/cm$^2$.

Investigation was performed on a relationship between a polishing-off thickness of the plate-shaped niobium samples chemically polished or electrolytically polished during the polishing and a hydrogen concentration in each of the samples. Results of the investigation are shown in FIG. 1. A polishing-off thickness was measured with an ultrasonic film thickness meter (manufactured by NOVA Co. with a model 800+). A hydrogen concentration was measured with RH-1E method of LECO Co.

From the results, it is found that in a plate-shaped niobium sample subjected to electrolytic polishing after mechanical polishing, an amount of hydrogen occluded as a solid solution increases in almost proportion to increase in polishing-off thickness, while on the other hand, in a sample subjected to chemical polishing after mechanical polishing, almost no increase was observed in amount of hydrogen occluded as a solid solution. Therefore, it was made clear that a great amount of hydrogen is occluded as a solid solution in a sample during electrolytic polishing.

Example 1

Preparation of Niobium Superconducting Accelerating Cavity—1

Installed in the apparatus of FIG. 2 was a single cell cavity of 1300 MHz with a total cavity length of 370 mm, the maximum cavity diameter of 210 mm, a beam pipe diameter of 80 mm and a thickness of 2.5 mm and the single cell cavity was subjected to centrifugal polishing. Conditions for centrifugal barrel polishing were in conformity with those of Test Example 1 and Fluorinert™ fluorine containing inert liquid (Fluorinert™) FC-77 manufactured by 3M Co. was employed as a liquid medium. After cleaning with pure water, the cavity was placed on a support table with a rotation activating function and an inverting function, a chemical polishing solution kept at 30° C. and composed of 89 w/v % phosphoric acid: 67 w/v % nitric acid: 40 w/v % hydrofluoric acid=1 vol: 1 vol: 1 vol was continuously fed at a flow rate of 10 L/min through the cavity while the cavity was rotated at 10 rpm, and chemical polishing was thus conducted in the cavity for 10 minutes (a target of polishing-off was 50 μm) as shown in FIG. 3. Thereafter, while the cavity is rotated, the polishing solution was rapidly discharged and, also, rolling and inverting were alternately effected in a repeated manner to clean the cavity by means of a common method. Note that the cavity was subjected to centrifugal barrel polishing with water as a liquid medium and then a single cell cavity chemically polished in conformity with Example 1 to prepare Comparative Example 1 corresponding to Example 1.

Figure 6:
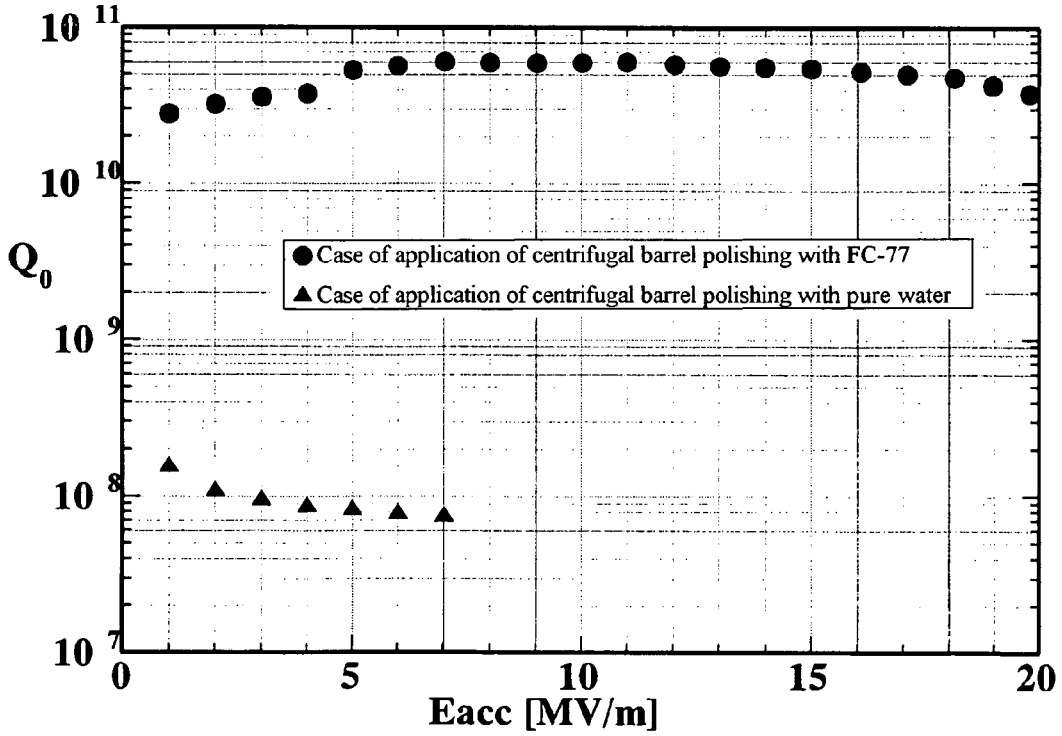
FIG. 6 is a graph showing acceleration performances of niobium single cell cavities one of which, in Example 1, is obtained by mechanically polishing an as formed niobium single cell with FC77 as a liquid medium, followed by chemical polishing on the work piece and the other of which, in Comparative Example 1, is obtained by mechanical polishing an as formed niobium single cell with water as a liquid medium, followed by chemically polishing on the work piece.

Total polishing-off thickness values of the cavities of Example 1 and Comparative Example 1 thus obtained were measured with the result of an average thickness of about 80 μm. Acceleration performances (Q-values and accelerating electric fields [Eacc: MV/m]) of the cavities are shown in FIG. 6. Note that a measurement test for an acceleration performance was conducted at 1.4 K to which the cavity was cooled after being held at 100K for 16 hours in order to clearly confirm reduction in Q-value due to occlusion of hydrogen as a solid solution. Reduction in Q-value was observed with a rise in an accelerating electric field in the cavity of Comparative Example 1 obtained in a procedure in which after centrifugal barrel polishing with pure water, chemical polishing was applied, whereas no reduction in Q-value in the cavity of Example 1 was observed even with a rise in accelerating electric field. Therefore, it was made clear that the accelerating cavity prepared in Example 1 has a very high acceleration performance.

Example 2

Preparation of Niobium Superconducting Accelerating Cavity—2

Subjected to centrifugal barrel polishing was a single cell cavity of 1300 MHz with a total cavity length of 370 mm, the maximum cavity diameter of 210 mm, a beam pipe diameter of 80 mm and a thickness of 2.5 mm in a similar way to that in Test Example 1. Note that a liquid obtained by blowing a mixed gas of ozone and oxygen (an ozone content relative to oxygen was 4%) prepared by an ozonizer into 850 ml of FC-77 for 20 minutes to cause the mixed gas to be saturated in FC-77 was used as a liquid medium used in centrifugal barrel polishing. An atmosphere inside the cavity was replaced with the mixed gas. After the centrifugal barrel polishing, the cavity was cleaned with pure water, followed by electrolytic polishing. Electrolytic polishing of the single cell cavity was conducted in a way such that the cavity was installed as shown in FIG. 4, an aluminum electrode pipe was mounted in the cavity, the cavity was returned to a horizontal state, an electrolytic polishing solution kept at 30° C. and composed of 98 w/v % sulfuric acid: 40 w/v % hydrofluoric acid: water=85 vol: 10 vol: 5 vol was continuously fed at a flow rate of 4 L/min through the cavity while the cavity was rotated at 0.4 rpm and a current was supplied at an average current density of 50 mA/cm$^2$. Note that average polishing-off thickness values in centrifugal barrel polishing and electrolytic polishing were about 30 μm and about 50 μm, respectively.

Figure 7:
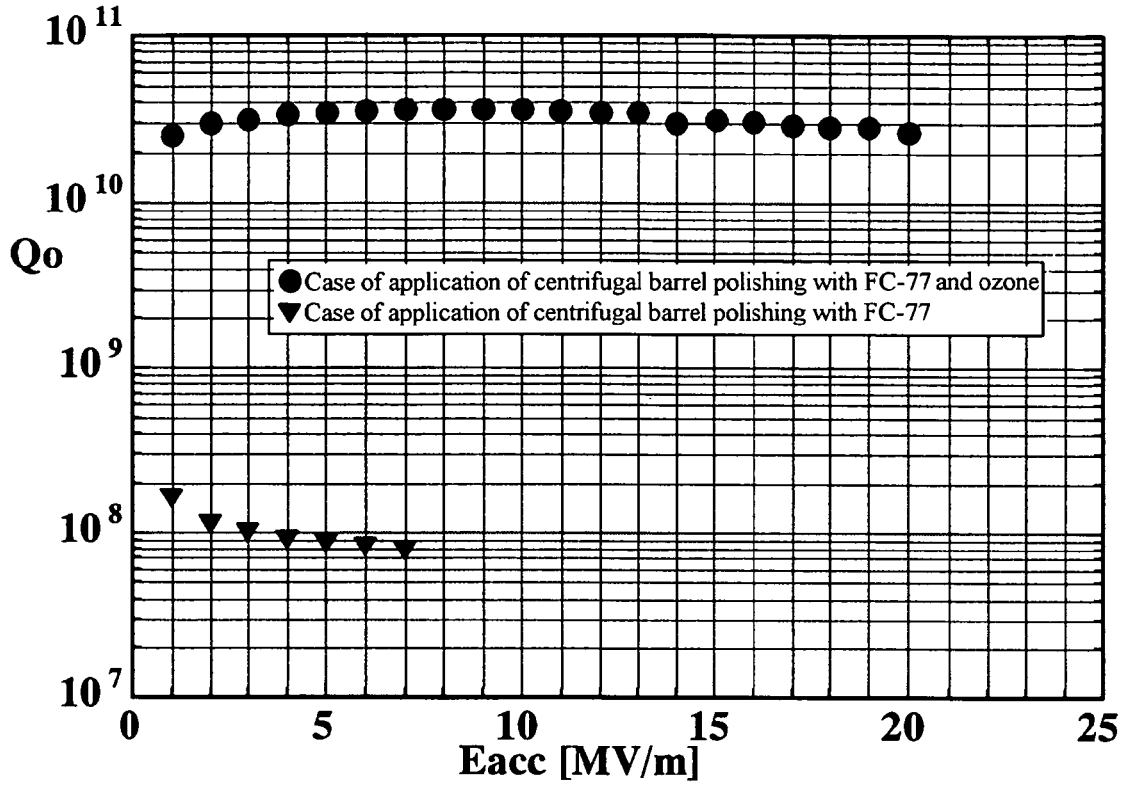
FIG. 7 is a graph showing acceleration performances of niobium single cell cavities one of which, in Example 2, is obtained by mechanically polishing an as formed niobium single cell in the presence of a liquid medium obtained by causing a mixture of ozone and oxygen to be absorbed into FC77, followed by electrolytic polishing on the work piece and the other of which, in Comparative Example 2, is obtained by mechanical polishing an as formed niobium single cell in the presence of a liquid medium made of FC77 only, followed by electrolytic polishing on the work piece.

A cavity was prepared as Comparative Example 2 in a procedure in which after centrifugal barrel polishing using only FC-77 as a liquid medium in centrifugal barrel polishing, electrolytic polishing was applied to the cavity in a similar way to that in Example 2. Shown in FIG. 7 are acceleration performances (Q-values and accelerating electric fields [Eacc: MV/m]) of superconducting accelerating cavities obtained in Example 2 and Comparative Example 2. Note that a measurement test for an acceleration performance was conducted at 1.4 K to which the cavity was cooled after being held at 100K for 16 hours in order to clearly confirm reduction in Q-value due to occlusion of hydrogen as a solid solution. A Q-value of the cavity of Comparative Example 2 obtained by centrifugal barrel polishing with FC-77 only as a liquid medium in centrifugal barrel polishing was reduced with a rise in accelerating electric field. In contrast to this, no Q-value of the accelerating cavity obtained in Example 2 was reduced even with a rise in accelerating electric field, which made clear that a cavity acceleration performance of Example 2 was higher.

Example 3

Preparation of Niobium Superconducting Accelerating Cavity—3

A plate-shaped niobium sample dehydrogenated in vacuum annealing was put into a single cell cavity of 1300 MHz with a total cavity length of 370 mm, the maximum cavity diameter of 210 mm, a beam pipe diameter of 80 mm and a thickness of 2.5 mm and subjected to centrifugal barrel polishing in conformity with Test Example 1. The niobium sample, after the barrel polishing, was taken out from the single cell cavity, cleaned with pure water and subjected to electrolytic polishing with an electrolytic polishing solution including nitric acid according to Test Example 1. Note that a barrel polishing-off thickness of the niobium sample was 30 μm and an electrolytic polishing-off thickness was 100 μm. On the other hand, the single cell cavity itself was electrolytically polished with an electrolytic polishing solution including nitric acid after the centrifugal barrel polishing. Electrolytic polishing of the single cell cavity was conducted in a way such that the cavity was installed as shown in FIG. 4, an aluminum electrode pipe was mounted in the cavity, the cavity was returned to a horizontal state, an electrolytic polishing solution kept at 30° C. and composed of 98 w/v % sulfuric acid: 67 w/v % nitric acid: 40 w/v % hydrofluoric acid: water =85 vol: 0.25 vol: 10 vol: 5 vol was continuously fed at a flow rate of 4 L/min through the cavity while the cavity was rotated at 0.4 rpm and a current is supplied at an average current density of 50 mA/cm$^2$.

A cavity was prepared as Comparative Example 3 in a procedure in which after centrifugal barrel polishing is applied in a similar way to that of Test Example 1, electrolytic polishing was conducted with an electrolytic polishing solution including no nitric acid. A composition of the electrolytic polishing solution was 98 w/v % sulfuric acid: 40 w/v % hydrofluoric acid: water=85 vol: 10 vol: 5 vol and the other conditions were in conformity with those of Example 3. Note that an average polishing-off thickness by electrolytic polishing was about 90 μm in each of Example 3 and Comparative Example 3.

Figure 8:
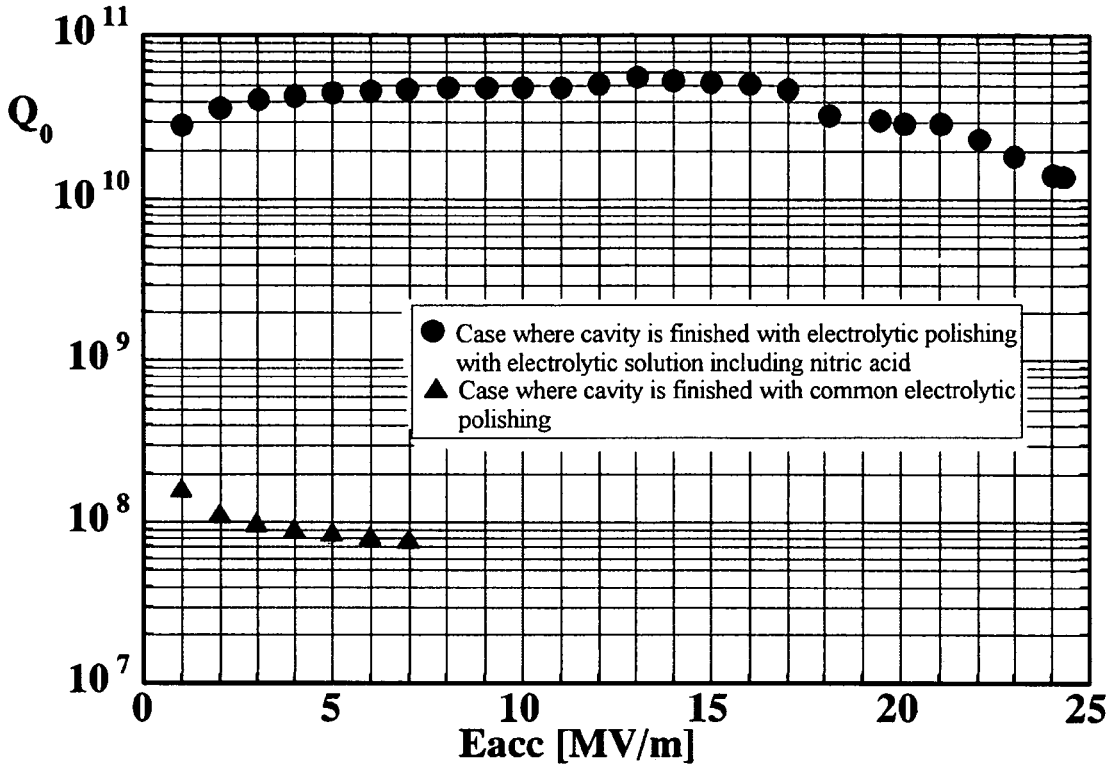
FIG. 8 is a graph showing acceleration performances of niobium single cell cavities one of which, in Example 3, is obtained by subjecting a niobium single cell cavity in process to electrolytic polishing using an electrolytic polishing solution including nitric acid after mechanical polishing and the other of which, in Comparative Example 3, is obtained by subjecting a niobium single cell cavity in process to electrolytic polishing using an electrolytic polishing solution including no nitric acid after mechanical polishing.

A hydrogen concentration in the plate-shaped niobium sample obtained in Example 3 was a very low value of 0.53±0.28 ppm. Note that shown in FIG. 8 are acceleration performances (Q-values and accelerating electric fields [Eacc: MV/m]) of the cavities of Example 3 and Comparative Example 3. From the results, it was made clear that a Q-value of the cavity of comparative Example 3 obtained by electrolytic polishing using an electrolytic polishing solution including no nitric acid is reduced with a rise in accelerating electric field, while a Q-value of the cavity prepared in Example 3 is not reduced even with a rise in accelerating electric field; therefore, the cavity of Example 3 exerts a high acceleration performance.

Example 4

Preparation of Niobium Superconducting Accelerating Cavity—4

A plate-shaped niobium sample dehydrogenated in vacuum annealing was put into a single cell cavity of 1300 MHz with a total cavity length of 370 mm, the maximum cavity diameter of 210 mm, a beam pipe diameter of 80 mm and a thickness of 2.5 mm and subjected to centrifugal barrel polishing in conformity with Example 2. Note that FC-77 alone was employed as a liquid medium. The niobium sample, after the barrel polishing, was taken out from the single cell cavity, cleaned with pure water and subjected to electrolytic polishing with an electrolytic polishing solution including nitric acid in conformity with Test Example 1. Note that a centrifugal barrel polishing-off thickness of the niobium sample was about 30 μm on average and an electrolytic polishing-off thickness was about 100 μm on average. On the other hand, the single cell cavity was electrolytically polished with an electrolytic polishing solution including nitric acid after the centrifugal barrel polishing in conformity with Example 2. A polishing solution for the electrolytic polishing was composed of 98 w/v % sulfuric acid: 67 w/v % nitric acid: 40 w/v % hydrofluoric acid: water=85 vol: 0.25 vol: 10 vol: 5 vol.

Figure 9:
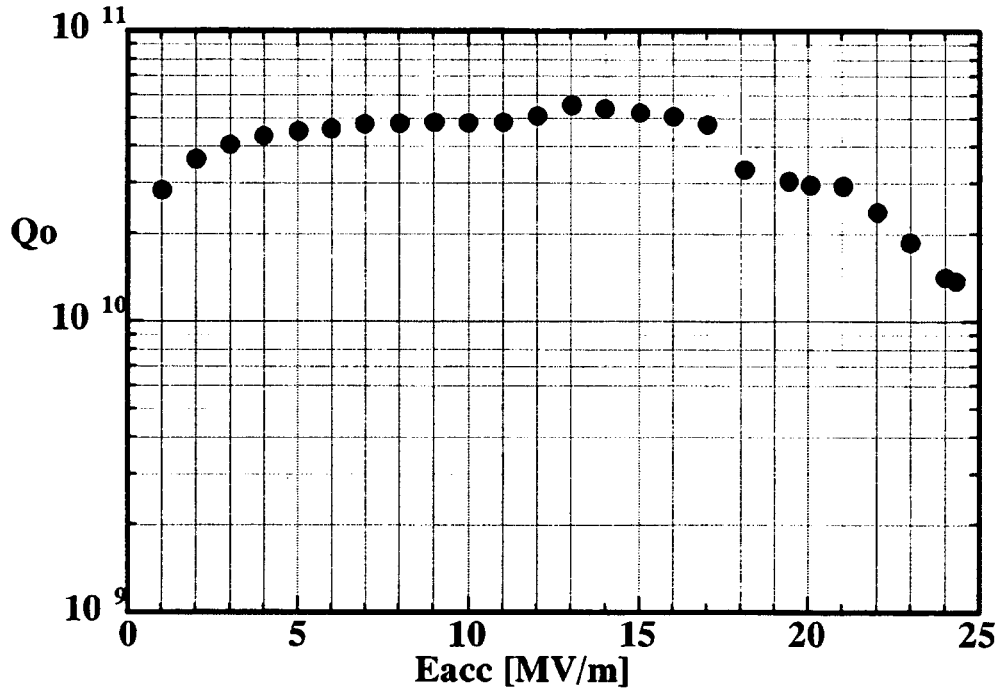
FIG. 9 is a graph showing an acceleration performance of a niobium single cell cavity obtained by, in Example 4, subjecting a niobium single cell cavity in process to electrolytic polishing using an electrolytic polishing solution including nitric acid after mechanical polishing.

A hydrogen concentration in the plate-shaped niobium sample obtained in Example 4 was a very low value of 0.53±0.28 ppm. Shown in FIG. 9 are acceleration performances of the cavity of the example (Q-values and accelerating electric fields [Eacc: MV/m]). An acceleration performance of Example 4 almost coincides with an acceleration performance of Example 2 and, from the results, it was also proved that a high acceleration performance was obtained of the cavity of Example 4 prepared by centrifugal barrel polishing in the presence of FC-77 in which ozone is absorbed.

Industrial Applicability

A performance of a vacuum member used in all fields of medicine, engineering, agriculture and others can be enhanced by means of the present invention.

The invention claimed is:

1. A surface-treating process comprising:

mechanically polishing an inner surface of a vacuum member in the presence of a liquid medium, or a liquid medium and an oxidizing material, wherein the liquid medium includes no hydrogen atom, wherein the vacuum member is made of one kind or two or more kinds selected from the group consisting of niobium, titanium, stainless steel, copper, aluminum and iron, and wherein the liquid medium including no hydrogen atom is a liquid at an ordinary temperature and an ordinary pressure and a saturated hydrocarbon in a molecule of which a hydrogen atom or hydrogen atoms are all substituted with a fluorine atom or fluorine atoms.

2. The surface-treating process according to claim 1, wherein the vacuum member is made of niobium.

3. The surface-treating process according to claim 1, wherein the vacuum member is a superconducting accelerating cavity.

4. The surface-treating process according to claim 1, wherein the mechanical polishing is performed in the presence of an oxidizing material.

5. The surface-treating process according to claim 4, wherein the oxidizing material is ozone, a mixture of ozone and oxygen, or hydrogen peroxide water.

6. The surface-treating process according to claim 1, wherein after the mechanical polishing, the inner surface of a vacuum member is subjected to chemical polishing or electrochemical polishing.

7. The surface-treating process according to claim 1, wherein after the mechanical polishing, the inner surface of a vacuum member is subjected to electrochemical polishing using an electrolytic solution including an oxidizing material.

8. The surface-treating process according to claim 7, wherein the oxidizing material is ozone, hydrogen peroxide water or nitric acid.

9. A forming process for a vacuum member comprising:

mechanically forming the vacuum member in the presence of a liquid medium, or a liquid medium and an oxidizing material, wherein the liquid medium includes no hydrogen atom, wherein the vacuum member is made of one kind or two or more kinds selected from the group consisting of niobium, titanium, stainless steel. copper. aluminum and iron, and wherein the liquid medium including no hydrogen atom is a liquid at an ordinary temperature and an ordinary pressure and a saturated hydrocarbon in a molecule of which a hydrogen atom or hydrogen atoms are all substituted with a fluorine atom or fluorine atoms.

10. A surface-treating process comprising:

(a) mechanically polishing an inner surface of a vacuum member in the presence of a liquid medium, or a liquid medium and an oxidizing material, wherein the liquid medium includes no hydrogen atom, wherein the vacuum member is made of one kind or two or more kinds selected from the group consisting of niobium, titanium, stainless steel, copper, aluminum and iron, and wherein the liquid medium including no hydrogen atom is a liquid at an ordinary temperature and an ordinary pressure and a saturated hydrocarbon in a molecule of which a hydrogen atom or hydrogen atoms are all substituted with a fluorine atom or fluorine atoms; and (b) electrochemically polishing the inner surface of a vacuum member using an electrolytic solution including an oxidizing material.

11. The surface-treating process according to claim 10, wherein the oxidizing material is ozone, hydrogen peroxide water or nitric acid.

12. The surface-treating process according to claim 10, wherein the oxidizing material is nitric acid.

* * * * *